US008540930B2

(12) United States Patent
Kwon et al.

(10) Patent No.: US 8,540,930 B2
(45) Date of Patent: Sep. 24, 2013

(54) REDUCING FURNACE AND APPARATUS FOR MANUFACTURING MOLTEN IRON COMPRISING THE SAME

(75) Inventors: Ki-Woong Kwon, Pohang-shi (KR); Suk-Kwang Jung, Pohang-shi (KR); Young-Gil Choi, Pohang-shi (KR); Do-Seung Kim, Pohang-shi (KR); Sung-Hee Chae, Pohang-shi (KR)

(73) Assignee: POSCO, Pohang (KR)

( * ) Notice: Subject to any disclaimer, the term of this patent is extended or adjusted under 35 U.S.C. 154(b) by 461 days.

(21) Appl. No.: 12/810,383

(22) PCT Filed: Dec. 18, 2008

(86) PCT No.: PCT/KR2008/007510
§ 371 (c)(1),
(2), (4) Date: Jun. 24, 2010

(87) PCT Pub. No.: WO2009/082125
PCT Pub. Date: Jul. 2, 2009

(65) Prior Publication Data

US 2010/0283192 A1 Nov. 11, 2010

(30) Foreign Application Priority Data

Dec. 24, 2007 (KR) ..... 10-2007-0136402

(51) Int. Cl.
*C21B 13/02* (2006.01)

(52) U.S. Cl.
USPC ..... 266/176; 266/184; 266/177

(58) Field of Classification Search
USPC ..... 266/176, 177, 172, 199, 184; 75/450, 75/443–447; 414/160; 193/16; 373/81
See application file for complete search history.

(56) References Cited

U.S. PATENT DOCUMENTS

| | | | | |
|---|---|---|---|---|
| 2,206,973 | A * | 7/1940 | Payne | 75/452 |
| 3,591,158 | A * | 7/1971 | Pantke et al. | 266/176 |
| 4,336,131 | A * | 6/1982 | Schmidt et al. | 209/3 |
| 4,395,179 | A | 7/1983 | Berzins | |
| 4,525,120 | A | 6/1985 | Legille et al. | |
| 6,585,798 | B2 * | 7/2003 | Choi et al. | 75/446 |
| 7,776,253 | B2 * | 8/2010 | Morozov et al. | 266/184 |
| 2006/0119023 | A1 * | 6/2006 | Shin et al. | 266/172 |
| 2009/0008841 | A1 | 1/2009 | Cho et al. | |
| 2011/0002758 | A1 | 1/2011 | Lonardi et al. | |

FOREIGN PATENT DOCUMENTS

| | | | |
|---|---|---|---|
| CA | 2636497 | A1 | 7/2007 |
| CA | 2640538 | A1 | 7/2007 |
| JP | 6035188 | U | 3/1985 |

(Continued)

*Primary Examiner* — Scott Kastler
*Assistant Examiner* — Michael Aboagye
(74) *Attorney, Agent, or Firm* — The Webb Law Firm

(57) ABSTRACT

An apparatus for manufacturing molten iron includes a reduction furnace having a charging device that is capable of preventing segregation. The reduction furnace for reducing an iron-containing material used for manufacturing molten iron may include a charging hole where the iron-containing material is charged, a first guide plate sloped toward a first direction in the reduction furnace to guide the iron-containing material to the inside of the reduction furnace, and a second guide plate fixed and sloped toward a second direction intersecting the first direction in the reduction furnace to guide the iron-containing material dropped and guided by the first guide plate. A dropping direction of the iron-containing material dropped and guided by the first guide plate is changed when the iron-containing material is guided by the second guide plate.

25 Claims, 7 Drawing Sheets

(56) References Cited

FOREIGN PATENT DOCUMENTS

| | | | | |
|---|---|---|---|---|
| KR | 20000013338 | U | | 7/2000 |
| KR | 2004098471 | | * | 10/2004 |
| KR | 1020050054849 | A | | 6/2005 |
| KR | 1020050089836 | A | | 9/2005 |
| KR | 100711774 | B1 | | 4/2007 |
| WO | 2004057038 | A1 | | 7/2004 |
| WO | 2005054520 | A1 | | 6/2005 |
| WO | 2006011774 | A1 | | 2/2006 |
| WO | WO 2006085795 | | * | 8/2006 |
| WO | 2007075025 | A1 | | 7/2007 |

* cited by examiner

REDUCING FURNACE AND APPARATUS FOR MANUFACTURING MOLTEN IRON COMPRISING THE SAME

TECHNICAL FIELD

The present invention relates to a reduction furnace and an apparatus for manufacturing a molten iron including the same. More particularly, the present invention relates to a reduction furnace including an iron-containing material charging device to prevent segregation and an apparatus for manufacturing a molten iron including the same.

BACKGROUND ART

Recently, a smelting reduction method that is capable of replacing the conventional blast furnace method has been developed. In the smelting reduction method, raw coal is directly used as a fuel and a reducing agent, and iron ore is directly used as an iron source. The iron ore is reduced in the reduction furnace and molten iron is formed in a melter-gasifier. Coal briquettes formed by pressing and molding raw coal to have a predetermined size are provided to the melter-gasifier, and oxygen gas is injected into the melter-gasifier to burn the coal briquettes. Thus, reduced iron may be melted.

The iron ore is charged into the reduction furnace so that the iron ore may be reduced. The iron ore may be directly charged into the reduction furnace without using additional devices, but the iron ore may not be uniformly dispersed in the reduction furnace. Thus, segregation may occur inside the reduction furnace.

The present invention provides a reduction furnace including a charging device that is capable of uniformly dispersing an iron-containing material without segregation.

In addition, the present invention provides an apparatus for manufacturing molten iron including the same.

SUMMARY OF THE INVENTION

In accordance with embodiments of the present invention, a reduction furnace for reducing an iron-containing material used for manufacturing molten iron includes a charging hole where the iron-containing material is charged, a first guide plate sloped toward a first direction in the reduction furnace to guide the iron-containing material to the inside of the reduction furnace, and a second guide plate fixed and sloped toward a second direction intersecting the first direction in the reduction furnace to guide the iron-containing material dropped and guided by the first guide plate. A dropping direction of the iron-containing material that is dropped and guided by the first guide plate is changed when the iron-containing material is guided by the second guide plate.

The first guide plate and the second guide plate may face the charging hole, respectively. At least one guide plate selected from the group consisting of the first guide plate and the second guide plate may be formed to as an arch. The second guide plate may be spaced apart from an imaginary line extending in a length direction of the reduction furnace to pass a center of the reduction furnace, and the imaginary line may meet the first guide plate. A convex portion may be formed at a lower portion of the second guide plate and the convex portion may be convex toward the imaginary line.

The reduction furnace may further include a guide tube where the first guide plate and the second guide plate are installed. The guide tube may include a first guide tube portion and a second guide tube portion connected to the first guide tube portion to be communicated with the first guide tube portion. A cross-section of the first guide tube portion may decrease along a proceeding direction of the iron-containing material.

A cross-section of the first guide tube may be larger than a cross-section of the second guide tube. The first guide plate may include an arch-type edge and the arch-type edge may contact an inner face of the first guide tube portion.

The second guide plate may be installed such that the second guide plate crosses the inside of the second guide tube portion. The first guide plate may be installed at the first guide tube portion and the second guide tube portion. The second guide tube portion may include a sloped portion and the sloped portion may be sloped in a direction substantially the same as the second direction. The sloped portion may be substantially parallel with the second guide plate. The first direction may be toward a plate face of the second guide plate. The first and second directions may form an angle of about 60° to about 140°.

A protrusion member protruded toward the charging hole may be formed on the first guide plate to contact the iron-containing material. The protrusion member may include a first sloped face and a second sloped face meeting the first sloped face and the first and second sloped faces contact the first guide plate. An end portion of an edge formed at a portion where the first and second sloped faces meet may contact the first guide plate.

The first direction may form an angle of about 20° to about 60° with an imaginary line extending in a length direction of the reduction furnace to pass a center of the reduction furnace, and the second direction may form an angle of about 20° to about 60° with an imaginary line extending in a length direction of the reduction furnace to pass a center of the reduction furnace.

The iron-containing material may include partially reduced iron or iron ore.

In accordance with embodiments of the present invention, an apparatus for manufacturing molten iron may include a reduction furnace for reducing an iron-containing material to form reduced iron and a melter-gasifier connected to the reduction furnace. The reduced iron may be charged into the melter-gasifier to form the molten iron. The reduction furnace may include a charging hole where the iron-containing material is charged, a first guide plate sloped toward a first direction in the reduction furnace to guide the iron-containing material to the inside of the reduction furnace, and a second guide plate fixed and sloped toward a second direction intersecting the first direction in the reduction furnace to guide the iron-containing material dropped and guided by the first guide plate. A dropping direction of the iron-containing material that is dropped and guided by the first guide plate may be changed when the iron-containing material is guided by the second guide plate.

The reduction furnace may be a packed-bed reduction furnace, and the iron-containing material may include iron ore. The apparatus may further include a device for forming compacted iron connected to the packed-bed reduction furnace to provide the packed-bed reduction furnace with the iron-containing material. The iron-containing material may be compacted by the device for forming the compacted iron.

The apparatus may further include a fluidized-bed reduction furnace connected to the device for forming the compacted iron to provide the device for forming the compacted iron with the iron-containing material. The fluidized-bed reduction furnace may pre-reduce the iron-containing material.

The reduction furnace may include the charging device. Thus, an iron-containing material may be uniformly dispersed. In addition, segregation of the iron-containing material may be prevented.

DETAILED DESCRIPTION OF THE INVENTION

Figure 1:
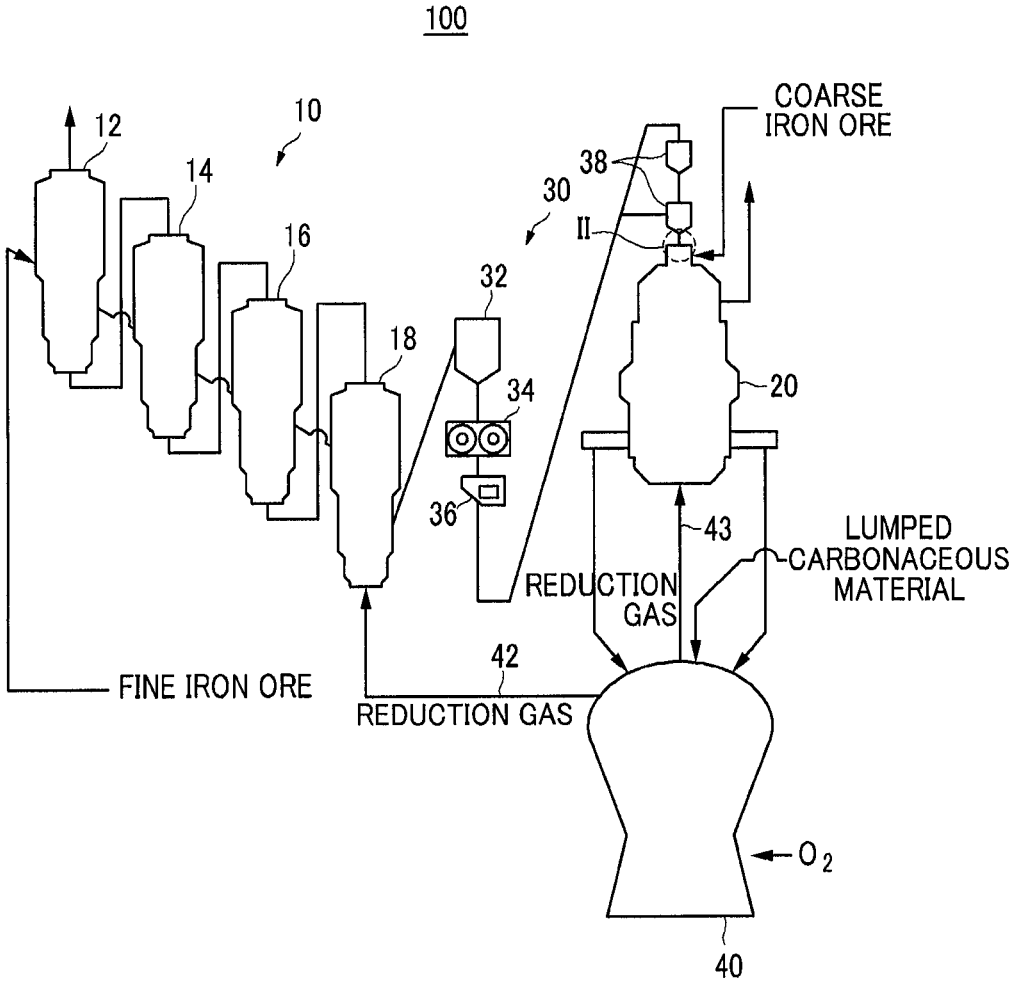
FIG. 1 schematically illustrates an apparatus for manufacturing molten iron 100 in accordance with a first embodiment of the present invention.

The present invention will be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will be understood that when an element or layer is referred to as being "on," "connected to," and/or "coupled to" another element or layer, the element or layer may be directly on, connected, and/or coupled to the other element or layer, or intervening elements or layers may be present. In contrast, when an element is referred to as being "directly on," "directly connected to," and/or "directly coupled to" another element or layer, no intervening elements or layers are present.

It will also be understood that, although the terms "first," "second," etc., may be used herein to describe various elements, components, regions, layers, and/or sections, these elements, components, regions, layers and/or sections should not be limited by these terms. Rather, these terms are used merely as a convenience to distinguish one element, component, region, layer, and/or section from another element, component, region, layer, and/or section. For example, a first element, component, region, layer, and/or section could be termed a second element, component, region, layer, and/or section without departing from the teachings of the present invention.

Spatially relative terms, such as "beneath," "below," "lower," "above," "upper," and the like, may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, when the device in the figures is turned over, elements described as below and/or beneath other elements or features would then be oriented above the other elements or features. The device may be otherwise oriented (rotated 90 degrees or at other orientations) and the spatially relative descriptors used herein are to be interpreted accordingly.

The terminology used herein is for the purpose of describing particular embodiments only and is not intended to limit of the invention. As used herein, the singular terms "a," "an," and "the" are intended to include the plural forms as well, unless the context clearly indicates otherwise. It will be further understood that the terms "includes" and "including" specify the presence of stated features, integers, steps, operations, elements, and/or components, but do not preclude the presence and/or addition of one or more other features, integers, steps, operations, elements, components, and/or groups thereof.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include a fourth member, whereas the expression "at least one selected from the group consisting of A, B, and C" does not.

As used herein, the expression "or" is not an "exclusive or" unless it is used in conjunction with the phrase "either." For example, the expression "A, B, or C" includes A alone; B alone; C alone; both A and B together; both A and C together; both B and C together; and all three of A, B, and, C together, whereas the expression "either A, B, or C" means one of A alone, B alone, and C alone, and does not mean any of both A and B together; both A and C together; both B and C together; and all three of A, B, and C together.

Unless otherwise defined, all terms (including technical and scientific terms) used herein may have the same meaning as what is commonly understood by one of ordinary skill in the art. It will be further understood that terms, such as those defined in commonly used dictionaries, should be interpreted as having a meaning that is consistent with their meaning in the context of this specification and the relevant art and will not be interpreted in an idealized and/or overly formal sense unless expressly so defined herein.

Embodiments of the present invention may be described with reference to cross-sectional illustrations, which are schematic illustrations of idealized embodiments of the present invention. As such, variations from the shapes of the illustrations, as a result, for example, of manufacturing techniques and/or tolerances, are to be expected. Thus, embodiments of the present invention should not be construed as limited to the particular shapes of regions illustrated herein, but are to include deviations in shapes that result from, e.g., manufacturing. For example, a region illustrated as a rectangle may have rounded or curved features. Thus, the regions illustrated in the figures are schematic in nature and are not intended to limit the scope of the present invention. Like reference numerals refer to like elements throughout.

An iron-containing material may be iron or a material including iron. For example, the iron-containing material may further include an additive. The iron-containing material may include iron ore. In addition, the iron-containing material may be pure iron, oxidized iron, or reduced iron. The iron-containing material may have various grain sizes. Thus, the iron-containing material may include pellets, fine iron ore, coarse iron ore, compacted iron, etc.

A reduction furnace is an apparatus that is capable of reducing the iron-containing material. The reduction furnace may include a fluidized-bed reduction furnace or a packed-bed reduction furnace.

FIG. 1 schematically illustrates an apparatus for manufacturing molten iron 100 in accordance with a first embodiment of the present invention.

As illustrated in FIG. 1, the apparatus for manufacturing molten iron 100 includes a fluidized-bed reduction furnace 10, a packed-bed reduction furnace 20, a device for forming compacted iron 30, and a melter-gasifier 40.

The apparatus for manufacturing molten iron 100 may manufacture molten iron by using iron ore or coal. Here, the iron ore may be fine iron ore or coarse iron ore. The fine iron ore may have a smaller grain size than that of the coarse iron ore. For example, the grain size of the fine iron ore may be smaller than about 8 mm and the grain size of the coarse iron ore may be larger than about 8 mm. Fluidized reduction of the fine iron ore may be achieved when the fine iron ore passes through the fluidized-bed reduction furnace 10. The coarse iron ore is reduced by the packed-bed reduction furnace 20.

The fluidized-bed reduction furnace 10 may fluidize the ion ore provided inside the fluidized-bed reduction furnace 10, and the fine iron ore may be used as the iron ore. An ingredient may be added in the fluidized-bed reduction furnace 10. A fluidized bed is formed in the fluidized-bed reduction furnace 10 to reduce the iron ore. The fluidized-bed reduction furnace 10 includes a first fluidized-bed reduction furnace 12, a second fluidized-bed reduction furnace 14, a third fluidized-bed reduction furnace 16, and a fourth fluidized-bed reduction furnace 18. At least one fluidized-bed reduction furnace may be used even though four fluidized-bed reduction furnaces are shown in FIG. 1. In addition, the fluidized-bed reduction furnace in FIG. 1 is an example of the present invention, and the fluidized-bed reduction furnace does not limit the scope of the present invention. Thus, other kinds of reduction furnaces may be used.

The first fluidized-bed reduction furnace 12 may pre-heat the iron ore by using a reduction gas exhausted from the second fluidized-bed reduction furnace 14. The second fluidized-bed reduction furnace 14 and the third fluidized-bed reduction furnace 16 may pre-reduce the pre-heated iron ore, and the fourth fluidized-bed reduction furnace 18 may finally reduce the pre-reduced iron ore to produce reduced iron. The reduced iron is transformed into compacted iron by the device for forming compacted iron 30.

The device for forming compacted iron 30 includes a charging hopper 32, a pair of rolls 34, and a crusher 36. In addition, the device for forming compacted iron 30 may include another unit. The charging hopper 32 may store the reduced iron. The pair of rolls 34 may press and mold the reduced iron provided from the charging hopper 32 to form the compacted iron having a strip shape. The compacted iron is crushed by the crusher 36 and then transferred to a hot pressure equalizing device 38.

The hot pressure equalizing device 38 may control pressure between both end portions to charge the compacted iron to the packed-bed reduction furnace 20. The coarse iron ore is also charged into the packed-bed reduction furnace 20. The coarse iron ore may not be charged into the packed-bed reduction furnace 20 even though the coarse iron ore is shown to be charged into the packed-bed reduction furnace in FIG. 1. The compacted iron and the coarse iron ore may be charged into the packed-bed reduction furnace 20 simultaneously, or the compacted iron and the coarse iron may be alternately charged. The reduction gas is provided to the packed-bed reduction furnace 20 through a reduction gas supplying line 43. A packed bed is formed in the packed-bed reduction furnace 20 so that the compacted iron and the iron-containing material including the coarse iron ore may be changed into the reduced iron.

The reduced iron is charged into the melter-gasifier 40. In addition, a lumped carbonaceous material including a volatile material is charged into the melter-gasifier 40. The lumped carbonaceous material is used as a heat source for melting the iron-containing material. The lumped carbonaceous material may be coal briquettes or a core, and the coal briquettes may be formed by pressing and molding coal dust. In addition, coke may be charged into the melter-gasifier 40.

The lumped carbonaceous material is charged to the melter-gasifier 40 to form a coal-packed bed. Oxygen (O2) is provided inside the melter-gasifier 40, and is provided to the coal-packed bed to form a raceway. The lumped carbonaceous material is burned in the raceway to produce a reduction gas, and the reduction gas is provided to the fluidized-bed reduction furnace 10 and the packed-bed reduction furnace 20 through the reduction gas supplying line 42 and the reduction gas supplying line 43, respectively. The fluidized-bed reduction furnace 10 and the packed-bed reduction furnace 20 may reduce the iron ore by using the reduction gas. The reduced iron is melted by burning the lumped carbonaceous material. In case that the reduced iron is melted, a molten iron is produced and then provided outward. Hereinafter, an inner structure of the packed-bed reduction furnace 20 in FIG. 1 may be described more detail.

Figure 2:
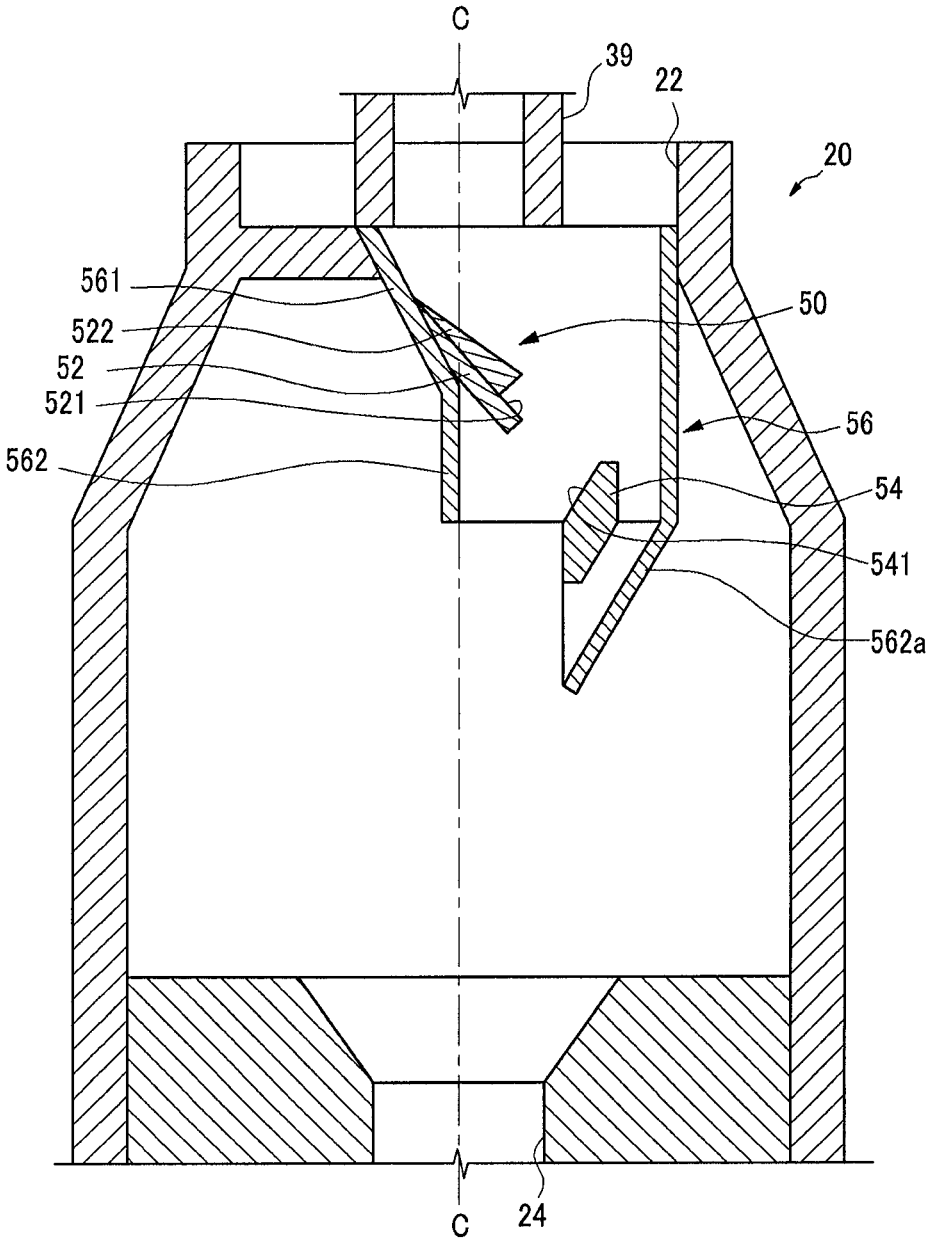
FIG. 2 illustrates an enlarged cross-section of a portion II in FIG. 1.

FIG. 2 illustrates an enlarged cross-section of a portion II in FIG. 1.

An imaginary line C (i.e., a dotted line) in FIG. 2 passes through the center of the packed-bed reduction furnace 20 and extends in a length direction (i.e., a z-axis direction) of the packed-bed reduction furnace 20.

As illustrated in FIG. 2, the packed-bed reduction furnace 20 includes a charging hole 22 and a charging device 50. The iron-containing material is charged through the charging hole 22, the charging device 50 is formed at an inner side of the packed-bed reduction furnace 20, and the iron-containing material is reduced in a lower space of the charging device 50.

The charging hole 22 is formed above the packed-bed reduction furnace 20. The iron-containing material is charged into the packed-bed reduction furnace 20 along a supplying line 39 communicated with the hot pressure equalizing device 38 (see FIG. 1). The charging device 50 may guide the dropping iron-containing material to adjust a dropping direction. Thus, the charging device 50 may control a distribution of the iron-containing material inside the packed-bed reduction furnace 20. The charging device 50 includes a first guide plate 52, a second guide plate 54, and a guide tube 56.

The first guide plate 52 is located to be met by the imaginary line C. That is, the first guide plate 52 is located at a center of the packed-bed reduction furnace 20. A plate face 521 of the first guide plate 52 may face the charging hole 22, and the first guide plate 52 may be sloped in a first direction to be installed at the guide tube 56. Here, the first direction is a direction in which the first guide late 52 extends downward. A protrusion member 522 is formed at the plate face 521 of the first guide plate 52, the protrusion member 522 may meet with the imaginary line C, and the protrusion member may be protruded toward the charging hole 22.

The second guide plate 54 is located under the first guide plate 52 to be spaced apart from the first guide plate 52. That is, the second guide plate 54 is located such that the second guide plate 54 may be spaced apart from the imaginary line C.

The plate face 541 of the second guide plate 54 may face the charging hole 22. The second guide plate 54 may be sloped in a second direction. Here, the second direction is a direction in which the second guide plate 54 extends downward. The second direction may intersect the first direction so that the first guide plate 52 and the second guide plate 54 may face different directions.

The guide tube 56 may guide the iron-containing material to the inside of the guide tube 56. The guide tube 56 is fixed to an inside of the packed-bed reduction furnace 20 by a fixing member (not shown). The first guide plate 52 and the second guide plate 54 are installed at an inner side of the guide tube 56, and the guide tube 56 includes a first guide tube portion 561 and a second guide tube portion 562.

The first guide tube portion 561 is located directly under the charging hole 22. A cross-section of the first guide tube portion 561 may decrease in a proceeding direction of the iron-containing material. That is, in a case in which the first guide tube portion 561 is cut in an xy plane direction, the cross-section of the first guide tube portion 561 may decrease in the proceeding direction of the iron-containing material. Thus, the iron-containing material charged into the packed-bed reduction furnace 20 through the supplying line 39 may be collected by the first guide tube portion 561 and then dropped downward.

The second guide tube portion 562 may be communicated with the first guide tube portion 561, and may be located under the first guide tube portion 561. Thus, the second guide tube portion 562 may contact the first guide tube portion 561 at a portion of the second guide tube portion 562 where a cross-section is a minimum. Thus, a cross-section of the first guide tube portion 561 may be larger than a cross-section of the second guide tube portion 562. As a result, the iron-containing material collected by the first guide tube portion 561 is not diffused by the second guide tube portion 562, and is effectively discharged to a dropping hole 24 as indicated by the arrow.

The second guide tube portion 562 includes a sloped portion 562*a*. The sloped portion 562*a* may face the dropping hole 24. Thus, the sloped portion 562*a* may guide the iron-containing material such that the iron-containing material is discharged into the dropping hole 24. The sloped portion 562*a* may be spaced apart from the second guide plate 54, and it may be sloped in a direction substantially the same as the second direction. Thus, the iron-containing material may be dropped in a direction that is substantially the same as a dropping direction in which the iron-containing material guided by the second guide plate 54 is dropped. As a result, the iron-containing materials may be effectively dropped without collisions with one another.

Figure 3:
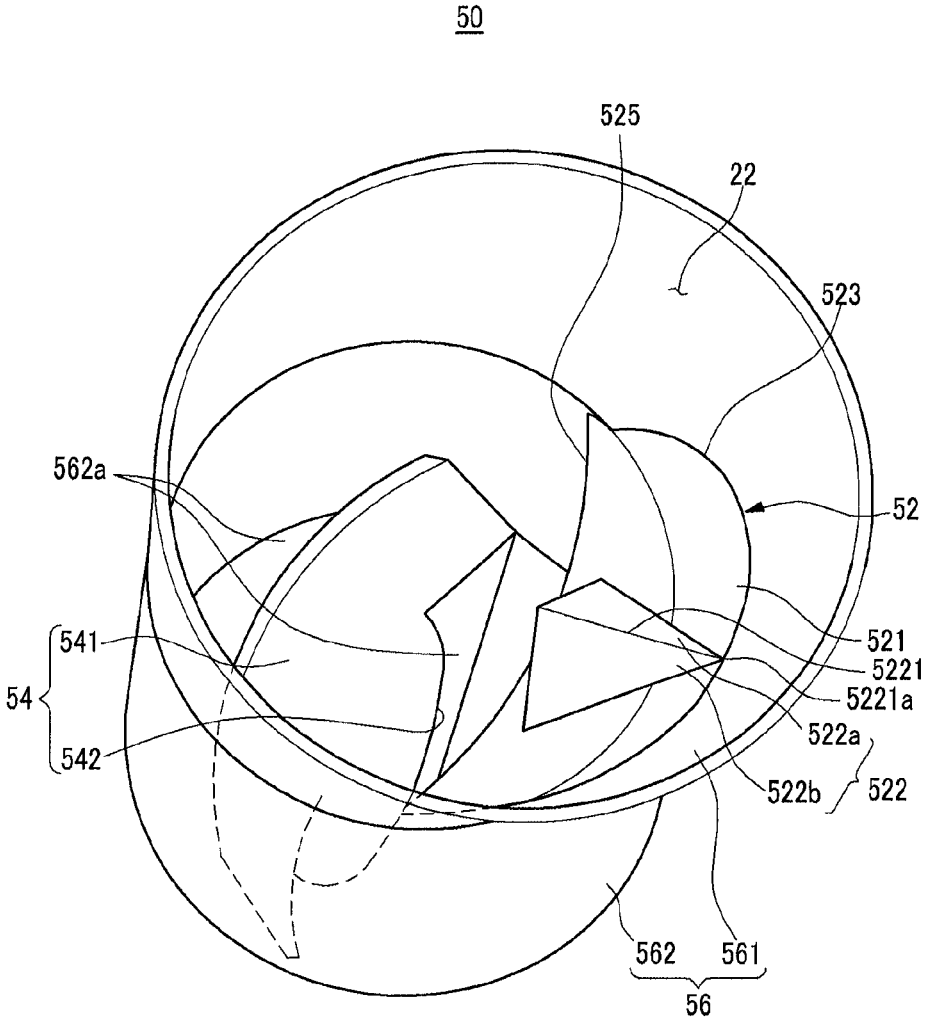
FIG. 3 is a partially cut perspective view illustrating the charging device 50 in FIG. 2.

FIG. 3 is a partially cut perspective view illustrating the charging device 50 in FIG. 2. FIG. 3 illustrates the inside of the charging device 50 from a viewpoint of the charging hole 22.

As illustrated in FIG. 3, the first guide plate 52 is formed from the first guide tube portion 561 and the second guide tube portion 562. That is, an upper portion of the first guide plate 52 is located at the first guide tube portion 561 and a lower portion of the first guide plate 52 is located at the second guide tube portion 562. The first guide plate 52 includes an arch-type edge 523. The edge 523 may have an arch shape corresponding to an inner shape of the first guide tube 56. Thus, the first guide plate 52 may be closely attached to an inner face of the guide tube 56. As a result, the iron-containing material may not leak between the first guide plate 52 and the guide tube 56. Another edge 525 facing the edge 523 may have a concave shape with respect to a center of the guide tube 56.

As illustrated in FIG. 3, a protrusion member 522 may be installed on the first guide plate 52. The protrusion member 522 may collide with the iron-containing material charged through the charging hole 22, and may include sloped faces 522*a* and 522*b*. The sloped faces 522*a* and 522*b* may include a first sloped face 522*a* and a second sloped face 522*b*. The first sloped face 522*a* and the second sloped face 522*b* may contact the first guide plate 52. Thus, the iron-containing material may not leak between the protrusion member 522 and the first guide plate 52. The first sloped face 522*a* and the second sloped face 522*b* may meet to form an edge 5221. An end portion 5221*a* of the edge 5221 may contact the first guide plate 52 so that the dropping iron-containing material may not pass between the protrusion member 522 and the first guide plate 52.

As illustrated in FIG. 3, the second guide plate 54 may be installed at the second guide tube portion 562. The second guide plate 54 may be formed to cross the inside of the second guide tube portion 562, and both edges of the second guide plate 54 may be fixed to the second guide tube portion 562. The second guide plate 54 includes a convex portion 542 formed under the second guide plate 54. Thus, the iron-containing material may pass by the convex portion 542 to be divided along both sides of the convex portion 542 when the iron-containing material is dropped. The iron-containing material may be uniformly dispersed by the convex portion 542.

The sloped portion 562*a* may be spaced apart from the second guide plate 54. Thus, a space may be formed between the sloped portion 562*a* and the second guide plate 54. A portion of the iron-containing material guided along the first guide plate 52 may be dropped through a space formed between the sloped portion 562*a* and the second guide plate 54, and the remaining iron-containing material may be dropped along the second guide plate 54.

Figure 4:
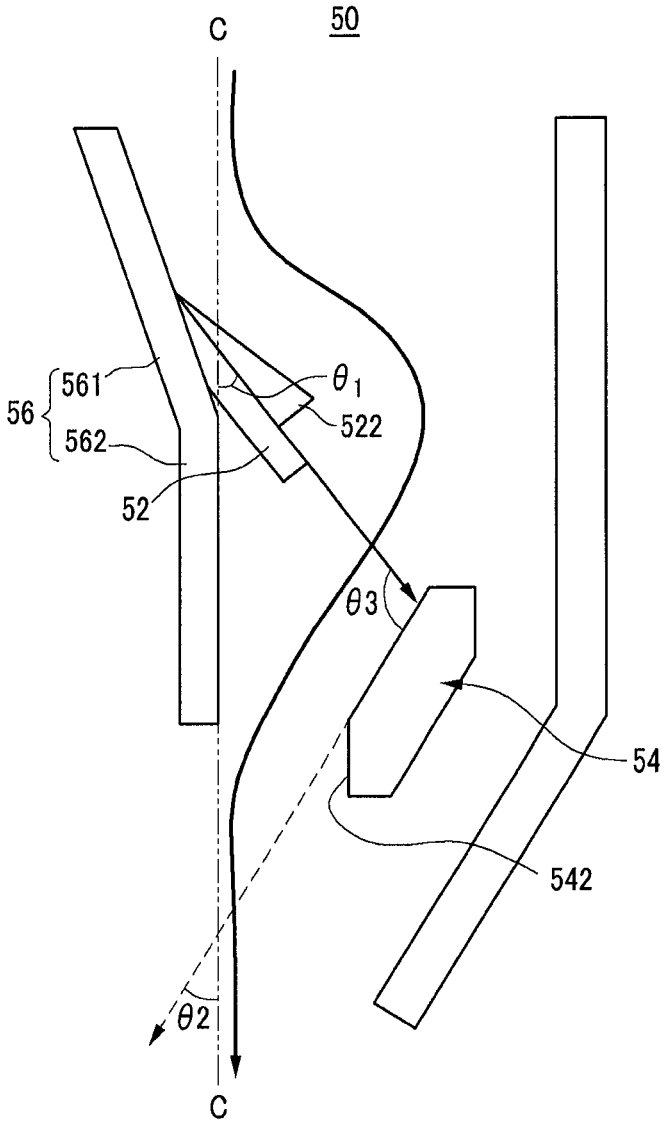
FIG. 4 is an enlarged view of the charging device 50 in FIG. 2.

FIG. 4 is an enlarged view of the charging device 50 in FIG. 2. A solid line arrow in FIG. 4 illustrates a first direction. A dotted line arrow in FIG. 4 illustrates the second direction.

As illustrated in FIG. 4, the first guide plate 52 and the second guide plate 54 may form an angle (θ1) and an angle (θ2), respectively, with the imaginary line (C). Here, the angle (θ1) may be about 20° to about 60°. If the angle (θ1) is less than about 20°, the iron-containing material may contact the first guide plate 52 and drop without contact with the second guide plate 54. If the angle (θ1) is more than about 60°, the iron-containing material may not drop and the iron-containing material may be stacked on the first guide plate 52. In addition, if the angle (θ2) is less than about 20°, the iron-containing material may not be effectively attached to the second guide plate 54 so that the direction of the iron-containing material may be hardly changed. In addition, in case that the angle (θ2) is over about 60°, the iron-containing material may not be dropped and the iron-containing material may be stacked between the first guide plate 52 and the second guide plate 54. In addition, when the angle (θ1) and the angle (θ2) are over about 60°, the dropping velocity of the iron-containing material may decease so that an effective supply of the iron-containing material may not be achieved. In addition, the time required for performing the processes may be delayed.

In addition, as illustrated in FIG. 4, the first direction and the second direction may form an angle (θ3). Here, the angle (θ3) may be about 60° to about 140°. If the angle (θ3) is less than about 60°, the dropping velocity of the iron-containing material may be rapidly decreased when iron-containing material is guided from the first guide plate 52 to the second guide plate 54. Thus, the iron-containing material may be stacked between the first guide plate 52 and the second guide plate 54. In addition, if the angle (θ3) is over about 140°, the proceeding direction of the iron-containing material may be hardly changed. Thus, it is difficult to uniformly disperse the iron-containing material inside the packed-bed reduction furnace 20 (see FIG. 1).

As illustrated in FIG. 4, the proceeding direction of the iron-containing material may be changed by the first guide plate 52 and the second guide plate 54 when the iron-containing material is dropped. The iron-containing material may be guided along the first direction by the first guide plate 52, and the iron-containing material may be guided along the second direction by the second guide plate 54. Thus, the iron-containing material may be dropped in a desired direction by controlling the first and second directions.

The protrusion member 522 may disperse the iron-containing material dropping along a center of the first guide plate 52 to the left or right sides. Thus, segregation may be prevented when the iron-containing material passes the first guide plate 52. The iron-containing material is then guided by the second guide plate 54, and is then dispersed to the left and right sides of the second guide plate 54 by the convex portion 542. Thus, the iron-containing material in which the segregation is prevented by passing the second guide plate 54 may be uniformly dispersed and dropped toward the dropping hole 24 (see FIG. 2).

Figure 5:
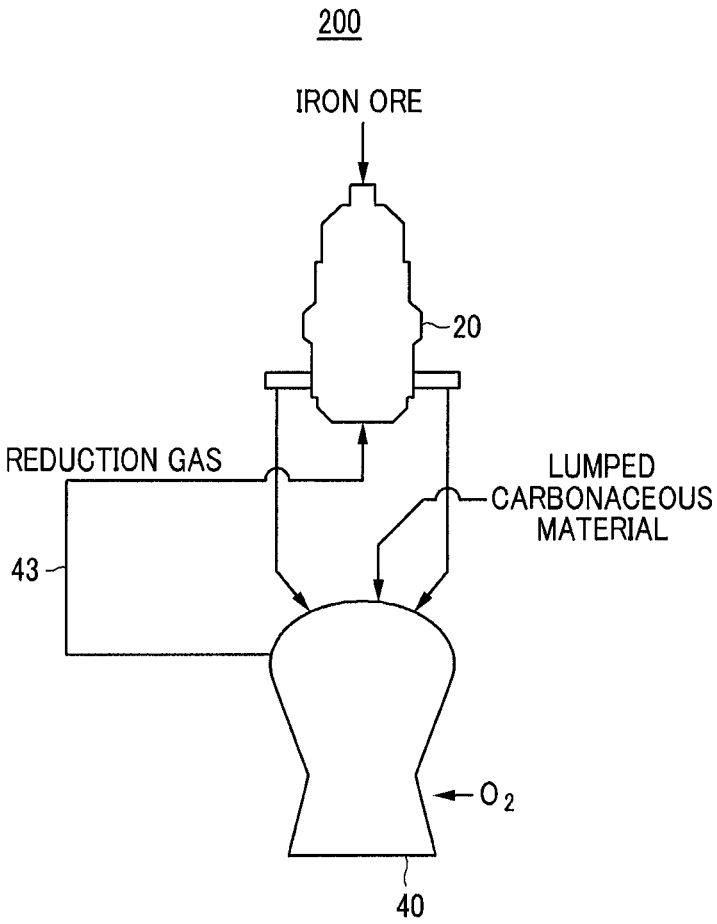
FIG. 5 illustrates an apparatus for manufacturing molten iron 200 in accordance with a second embodiment of the present invention.

FIG. 5 illustrates an apparatus for manufacturing molten iron 200 in accordance with a second embodiment of the present invention. The apparatus for manufacturing molten iron 200 in FIG. 5 is substantially the same as the apparatus for manufacturing molten iron 100 in FIG. 1. Thus, the same reference numerals will be used to refer to the same or like parts, and further explanation will be omitted.

As illustrated in FIG. 5, the apparatus for manufacturing molten iron 200 includes a packed-bed reduction furnace 20. Iron ore is discharged into the packed-bed reduction furnace 20, and a reduction gas produced from the melter-gasifier 40 may be provided to the packed-bed reduction furnace 20 through the reduction gas supplying line 43.

Thus, the packed-bed reduction furnace 20 may transform the iron ore into reduced iron by using the reduction gas. The reduced iron is charged into the melter-gasifier 40 and then melted by a coal-packed bed formed by a lumped carbonaceous material. Thus, the molten iron 40 may be formed by the melter-gasifier 40. Here, the packed-bed reduction furnace 20 may include the charging device 50 (see FIG. 2).

Hereinafter, the present invention is more fully described with reference to examples. The examples are provided so that this disclosure will be thorough and complete, and this invention should not be construed as limited to the examples set forth herein.

Example

Reduced iron was charged into a packed-bed reduction furnace in FIG. 2. Distribution of the reduced iron stacked inside the packed-bed reduction furnace was then measured using the center of the packed-bed reduction furnace as the origin. The distribution of the reduced iron dispersed in all directions with respect to the origin is shown by using a graph.

Result of Example

Figure 6:
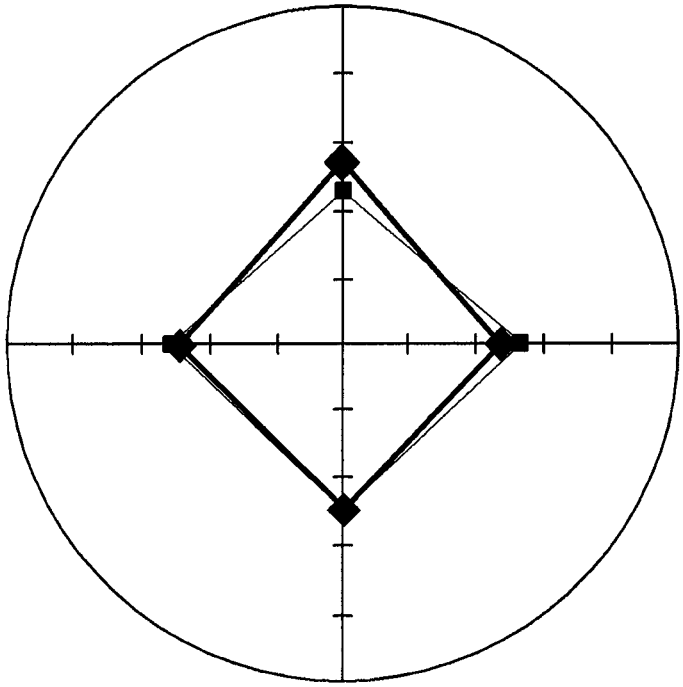
FIGS. 6 and 7 show distributions of iron-containing materials in accordance with an example and a comparative example, respectively.

FIG. 6 shows the distribution of the dropped reduced iron in accordance with the example. The circle in FIG. 6 is an inner cross-section of the packed-bed reduction furnace. A region represented by the heavy line in FIG. 6 is a region where the reduced iron having a grain size over about 20 mm is dispersed, and a region represented by the light line is a region where the reduced iron having a grain size smaller than about 20 mm is dispersed.

As illustrated in FIG. 6, the reduced iron is uniformly dispersed in the packed-bed reduction furnace in all directions. That is, the reduced iron is not gathered in a predetermined direction so that the segregation may not be generated. The reduced iron is uniformly dispersed with respect to a center of the dropping hole regardless of the grain size.

Comparative Example

Reduced iron was charged into a conventional packed-bed reduction furnace that did not include a charging device. Distribution of the reduced iron stacked in the packed-bed reduction furnace was measured, using the center of the packed-bed reduction furnace as the origin. The distribution of the reduced iron dispersed in all direction with respect to the origin is shown by using a graph.

Result of Comparative Example

Figure 7:
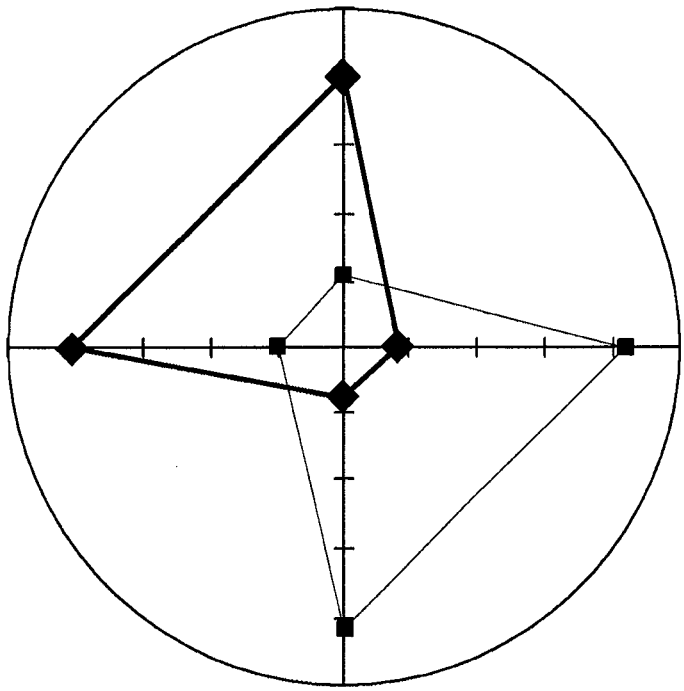

FIG. 7 shows the distribution of the dropped reduced iron in accordance with the comparative example. The circle in FIG. 7 is an inner cross-section of the packed-bed reduction furnace.

A region represented by the heavy line in FIG. 7 is a region where the reduced iron having a grain size over about 20 mm is dispersed, and a region represented by the light line is a region where the reduced iron having a grain size smaller than about 20 mm is dispersed.

As illustrated in FIG. 7, the reduced iron is dispersed in the packed-bed reduction furnace such that the distribution leans toward a certain direction with respect to the origin.

That is, the distribution of the reduced iron having a grain size over about 20 mm leans upward to the left side of the packed-bed reduction furnace, and the distribution of the reduced iron having a grain size less than about 20 mm leans downward to the right side of the packed-bed reduction furnace. As described above, the distribution of the reduced iron leans in certain directions with respect to the origin. The reduced iron is dispersed in opposite directions with respect to the origin in accordance with the grain size.

As described in the example, if the charging device is installed, the reduced iron may be uniformly dispersed in the packed-bed reduction furnace and the segregation may not be generated. If the reduced iron is uniformly dispersed in the packed-bed reduction furnace, flow of the reduction gas in the packed-bed reduction furnace becomes uniform. Thus, a re-reduction rate of the reduced iron may be largely improved. On the other hand, as described above, if the charging device is not installed in the packed-bed reduction furnace, the distribution of the reduced iron is not uniform. Thus, it is difficult to improve the re-reduction rate of the reduced iron because the segregation problem is not solved.

The foregoing is illustrative of the present invention and is not to be construed as limiting thereof. Although a few embodiments of this invention have been described, those skilled in the art will readily appreciate that many modifications are possible in the embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A reduction furnace for reducing an iron-containing material used for manufacturing molten iron, the reduction furnace comprising:

a charging hole where the iron-containing material is charged into the reduction furnace;

a first guide plate in the reduction furnace, the first guide plate being sloped toward a first direction to guide the iron-containing material to a lower space of the inside of the reduction furnace;

a second guide plate in the reduction furnace, the second guide plate being fixed and sloped toward a second direction intersecting the first direction to guide the iron-containing material dropped and guided by the first guide plate; and a guide tube where the first guide plate and the second guide plate are installed, wherein a dropping direction of the iron-containing material dropped and guided by the first guide plate is changed when the iron-containing material is guided by the second guide plate, and wherein the guide tube comprises:

a first guide tube portion; and a second guide tube portion connected to the first guide tube portion to be communicated with the first guide tube portion, wherein a cross-section of the first guide tube portion decreases along a preceding direction of the iron-containing material.

2. The reduction furnace of claim 1, wherein the first guide plate and the second guide plate face the charging hole, respectively.

3. The reduction furnace of claim 2, wherein at least one guide plate selected from the group consisting of the first guide plate and the second guide plate is formed as an arch.

4. The reduction furnace of claim 1, wherein the second guide plate is spaced apart from an imaginary line extending in a length direction of the reduction furnace to pass a center of the reduction furnace.

5. The reduction furnace of claim 4, wherein the imaginary line meets the first guide plate.

6. The reduction furnace of claim 4, wherein a convex portion is formed at a lower portion of the second guide plate and the convex portion is convex toward the imaginary line.

7. The reduction furnace of claim 1, wherein the cross-section of the first guide tube portion is larger than a cross-section of the second guide tube portion.

8. The reduction furnace of claim 1, wherein the first guide plate includes an arch-type edge and the arch-type edge contacts an inner face of the first guide tube portion.

9. The reduction furnace of claim 1, wherein the second guide plate is installed such that the second guide plate crosses the inside of the second guide tube portion.

10. The reduction furnace of claim 1, wherein the first guide plate is installed at the first guide tube portion and the second guide tube portion.

11. The reduction furnace of claim 1, wherein the second guide tube portion includes a sloped portion and the sloped portion is sloped in a direction that is substantially the same as the second direction.

12. The reduction furnace of claim 11, wherein the sloped portion is substantially parallel with the second guide plate.

13. The reduction furnace of claim 1, wherein the first direction is toward a plate face of the second guide plate.

14. The reduction furnace of claim 1, wherein the first and second directions forms an angle of about 60° to about 140°.

15. The reduction furnace of claim 1, wherein a protrusion member protruded toward the charging hole is formed on the first guide plate to contact the iron-containing material.

16. The reduction furnace of claim 15, wherein the protrusion member include a first sloped face and a second sloped face meeting the first sloped face, and the first and second sloped faces contact the first guide plate.

17. The reduction furnace of claim 16, wherein an end portion of an edge formed at a portion where the first and second sloped faces meet contacts the first guide plate.

18. The reduction furnace of claim 1, wherein the first direction forms an angle of about 20° to about 60° with an imaginary line extending in a length direction of the reduction furnace to pass a center of the reduction furnace.

19. The reduction furnace of claim 1, wherein the second direction forms an angle of about 20° to about 60° with an imaginary line extending in a length direction of the reduction furnace to pass a center of the reduction furnace.

20. The reduction furnace of claim 1, wherein the iron-containing material includes partially reduced iron or iron ore.

21. An apparatus for manufacturing molten iron, comprising:

a reduction furnace reducing an iron-containing material to form reduced iron; and a melter-gasifier connected to the reduction furnace, the reduced iron being charged into the melter-gasifier to form the molten iron, wherein the reduction furnace comprises:

a charging hole where the iron-containing material is charged into the reduction furnace;

a first guide plate in the reduction furnace, the first guide plate being sloped toward a first direction to guide the iron-containing material to a lower space of the reduction furnace;

a second guide plate in the reduction furnace, the second guide plate being fixed and sloped toward a second direction intersecting the first direction to guide the iron-containing material dropped and guided by the first guide plate; and a guide tube where the first guide plate and the second guide plate are installed, wherein a dropping direction of the iron-containing material dropped and guided by the first guide plate is changed when the iron-containing material is guided by the second guide plate, and wherein the guide tube comprises:

a first guide tube portion; and a second guide tube portion connected to the first guide tube portion to be communicated with the first guide tube portion, wherein a cross-section of the first guide tube portion decreases along a preceding direction of the iron-containing material.

22. The apparatus of claim 21, wherein the reduction furnace is a packed-bed reduction furnace.

23. The apparatus of claim 22, wherein the iron-containing material includes iron ore.

24. The apparatus of claim 22, further comprising a device for forming compacted iron connected to the packed-bed reduction furnace to provide the packed-bed reduction furnace with the iron-containing material, wherein the iron-containing material is compacted by the device for forming the compacted iron.

25. The apparatus of claim 24, further comprising a fluidized-bed reduction furnace connected to the device for forming the compacted iron to provide the device for forming compacted iron with the iron-containing material, wherein the fluidized-bed reduction furnace pre-reduces the iron-containing material.

* * * * *